US005112711A

United States Patent [19]

Nguyen et al.

[11] Patent Number: 5,112,711

[45] Date of Patent: May 12, 1992

[54] ELECTROPHOTOGRAPHIC RECORDING ELEMENTS CONTAINING A COMBINATION OF TITANYL PHTHALOCYANINE-TYPE PIGMENTS

[75] Inventors: Khe Chanh Nguyen, Pittsford; Thomas R. Klose, Fairport, both of N.Y.

[73] Assignee: Eastman Kodak Company, Rochester, N.Y.

[21] Appl. No.: 533,634

[22] Filed: Jun. 5, 1990

[51] Int. Cl.[5] ..... G03G 5/06

[52] U.S. Cl. ..... 430/58; 430/78; 430/83

[58] Field of Search ..... 430/78, 83, 58

[56] References Cited

U.S. PATENT DOCUMENTS

| | | | |
|---|---|---|---|
| 4,443,528 | 4/1984 | Tumara et al. | 430/56 |
| 4,587,188 | 5/1986 | Kato et al. | 430/58 |
| 4,701,396 | 10/1987 | Hung et al. | 430/58 |
| 4,725,519 | 2/1988 | Suzuki et al. | 430/58 |
| 4,981,767 | 1/1991 | Tokura et al. | 430/78 |

FOREIGN PATENT DOCUMENTS

| | | |
|---|---|---|
| 62-272272 | 11/1987 | Japan . |
| 2145835A | 4/1985 | United Kingdom . |

*Primary Examiner*—John Goodrow
*Attorney, Agent, or Firm*—David F. Janci

[57] ABSTRACT

An electrophographic recording element comprising a combination of photoconductive titanyl phthalocyanine and titanyl fluorophthalocyanine pigments. The pigments or charge-generation materials are dispersed in a binder to form a layer having excellent photosensitivity and resistance to abrasion.

6 Claims, No Drawings

ELECTROPHOTOGRAPHIC RECORDING ELEMENTS CONTAINING A COMBINATION OF TITANYL PHTHALOCYANINE-TYPE PIGMENTS

FIELD OF THE INVENTION

This invention relates to electrophotographic recording elements containing a combination of photoconductive materials that are titanyl phthalocyanine-type pigments. More particularly, the invention relates to such elements containing a combination of a titanyl phthalocyanine pigment with a titanyl fluorophthalocyanine pigment that can be coated in a dispersion to form layers that exhibit unexpectedly good photosensitivity, particularly in the near infrared region of the spectrum. Such layers are highly resistant to abrasion and, therefore, exhibit good durability.

BACKGROUND

In electrophotography an image comprising an electrostatic field pattern usually of non-uniform strength (also referred to as an electrostatic latent image), is formed on an insulative surface of an electrophotographic recording element comprising at least a photoconductive layer and an electrically conductive substrate. Several types of electrophotographic recording elements are known for use in electrophotography. In many conventional elements, the active photoconductive or charge-generation materials are contained in a single layer. This layer is coated on a suitable electrically conductive support or on a non-conductive support that is overcoated with an electrically conductive layer. In addition to single-active-layer electrophotographic recording elements, various multiactive electrophotographic recording elements are known. Such elements are sometimes called multi-layer or multiactive-layer elements because they contain at least two active layers that interact to form an electrostatic latent image.

A class of photoconductive materials that has been employed in the aforementioned single-active layer and multiactive elements is titanyl phthalocyanine-type pigments such as titanyl phthalocyanine pigment or titanyl fluorophthalocyanine pigment. Electrophotographic recording elements containing such pigments as photoconductive or charge-generation materials are useful in electrophotographic laser beam printers because they are capable of providing photosensitivity in at least a portion of the near infrared region of the electromagnetic spectrum, i.e. in the range of 700–900 nm.

Unfortunately, electrophotographic recording elements of the prior art which contain photoconductive titanyl phthalocyanine-type pigments have typically suffered from one or more disadvantages that have significantly restricted their use. Thus, without special processing techniques or treatments, neither titanyl phthalocyanine pigment nor titanyl fluorophthalocyanine pigment provides sufficient electrophotographic speed in the near infrared range that is needed in modern-day mid- to high volume laser beam printers and particularly the high electrophotographic speed that is needed at longer wavelengths such as 830–900 nm within such range. For example, vacuum sublimation (also known as vacuum deposition) is often used to deposit titanyl phthalocyanine-type pigments is a form suitable for high speed electrophotographic elements. Vacuum sublimation, however, is a batch process which makes production scale runs quite costly and thin sublimed films are fragile and susceptible to damage until they can be protected by a more durable overcoat.

U.S. Pat. No. 4,701,396, issued Oct. 20, 1987, also points out that photoconductive titanyl phthalocyanine-type pigments are not readily dispersible in liquid coating compositions comprising solvent solutions of polymeric binders which are used to dispersion coat charge generation layers in electrophotographic recording elements. It is necessary that the titanyl phthalocyanine-type pigment be in a form (crystalline or amorphous) that is highly photoconductive and sufficiently and stably dispersed in a coating composition to permit its being applied at a low enough concentration to form a very thin layer having acceptable electrophotographic speed in the near infrared range.

In U.S. Pat. No. 4,701,396, titanyl fluorophthalocyanine pigment is subjected to a treatment which modifies its crystalline form and reduces its particle size so that the pigment can be dispersed in liquid coating compositions comprising a solvent solution of polymeric binder. This treatment is called "acid-pasting" which involves dissolving the pigment (after extraction purification of the as-synthesized material) in cold, concentrated mineral acid, preferably sulfuric acid, and pouring the solution into ice water to re-precipitate the pigment. The precipitate is washed free of acid with water, then with an alcohol and dried. The resulting titanyl fluorophthalocyanine pigment has a substantially smaller particle size (slightly less than 1 micrometer) than the crude pigment and is highly sensitive to radiation in the near infrared range. In commercial scale operations it is, of course, desirable to avoid using large amounts of concentrated mineral acids such as sulfuric acid because of safety and environmental considerations. It is also very costly to provide the necessary safeguards for handling such a hazardous material.

This invention is directed toward the objective of providing electrophotographic recording elements that comprise titanyl phthalocyanine-type pigments and have excellent photosensitivity in the near infrared range without using special coating techniques such as vacuum sublimation or chemical treatments such as acid-pasting.

SUMMARY OF THE INVENTION

In accordance with this invention, certain combinations of at least two photoconductive titanyl phthalocyanine-type pigments act synergistically to provide electrophotographic recording elements having unexpectedly high photosensitivity in the near infrared range. Thus, such elements exhibit an electrophotographic speed that is superior to the electrophotographic speed of comparable electrophotographic recording elements that use only one of the components of the combination as the photoconductive material. The electrophotographic speed, as described herein, is the energy required (determined and reported in ergs/cm$^2$) to discharge an electrophotographic recording element from a potential of 500 V to 100 V when the element is exposed at its maximum wavelength within the near infrared range. The combination of photoconductive pigments used in this invention forms stable, uniform dispersions in organic liquids that can be coated to provide electrophotographic elements having excellent photosensitivity, for example, photodischarge speed and dark decay, in the near infrared range without the need for vacuum sublimation techniques. Furthermore, the electrophotographic elements of this invention exhibit a broad range of sensitivity, i.e., they exhibit excellent electrophotographic response over a broad region of the electromagnetic spectrum from 400 to 900 nm and particularly at wavelengths within the near infrared range that are longer than about 830 nm. Accordingly, this invention provides an electrophotographic recording element containing photoconductive materials dispersed in a binder wherein the photoconductive materials comprise a combination of pigments of (A) titanyl phthalocyanine with (B) titanyl fluorophthalocyanine having the formula:

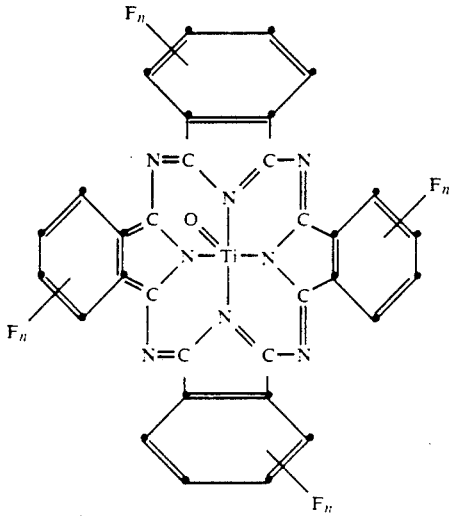

where n is an integer of 1-4.

As described in greater detail hereinafter, the specific titanyl phthalocyanine-type pigment used in the practice of this invention is critical. Thus, as illustrated in the following Example 4 and 4A, closely structurally related titanyl chloro- or bromophthalocyanine pigments cannot be substituted for the corresponding fluorinated pigment to provide the synergistic increase in electrophotographic response obtained according to this invention.

DESCRIPTION OF THE PREFERRED EMBODIMENTS

The photoconductive or charge-generation materials employed in the practice of this invention are titanyl phthalocyanine pigments and titanyl fluorophthalocyanine pigments having the formula set forth hereinbefore. Such pigments are well known in the prior art and typical procedures for preparing them are described, for example, in U.S. Pat. No. 4,701,396 and U.S. Pat. No. 4,725,519, the disclosures of which are hereby incorporated herein by reference. As indicated in U.S. Pat. No. 4,701,396, the titanyl fluorophthalocyanine pigments can exist in the form of several isomers. This invention includes within its scope, such isomers. Specific examples of titanyl fluorophthalocyanines that are useful in the practice of this invention include titanyl 2,9,16,23-tetrafluorophthalocyanine, titanyl 2,10,17,24-tetrafluorophthalocyanine, titanyl 1,8,15,22-tetrafluorophthalocyanine titanyl 1,11,18,25-tetrafluorophthalocyanine, titanyl 2,3,9,10,16,17,23,24-octafluorophthalocyanine, titanyl 1,4,8,11,15,18,22,25-octafluorophthalocyanine and titanyl hexadecylfluorophthalocyanine. Titanyl tetrafluorophthalocyanine pigments are most convenient to synthesize and are preferably employed in the practice of this invention. The titanyl tetrafluorophthalocyanine employed in the following Examples to illustrate this invention is primarily titanyl 2,9,16,23-tetrafluorophthalocyanine pigment.

In their as-synthesized form, the titanyl phthalocyanine-type pigments generally have a larger particle size than does the electrophotographic quality pigment, i.e., the photoconductive titanyl phthalocyanine pigment or photoconductive titanyl fluorophthalocyanine pigment. The particle size of the as-synthesized titanyl phthalocyanine-type pigments can be reduced to a particle size which is generally effective for electrophotographic applications by such well known methods as milling in conventional ball mills, roll mills, paint shakers, vibrating mills, attritors and the like. Such milling processes can employ milling media such as glass beads, steel beads and milling aids such as sodium chloride or other inorganic salts. The combination of titanyl phthalocyanine-type pigments used in practicing this invention can be milled as the combination but optimum electrophotographic properties are generally obtained when the titanyl phthalocyanine pigment and the titanyl fluorophthalocyanine pigment are milled separately and added to the coating composition prior to coating the electrophotographic recording element. The as-synthesized pigments can also be subjected to chemical treatments such as acid pasting as is described in U.S. Pat. No. 4,701,396, although, as previously indicated herein, such treatments are not required for the practice of this invention. In general, the photoconductive titanyl phthalocyanine pigments and titanyl fluorophthalocyanine pigments employed in the practice of this invention have a particle size that does not exceed about 0.5 micrometer. Normally the particle size is in the range of about 0.01 to 0.5 micrometer and often in the range of about 0.05 to 0.1 micrometer. The pigment particles have a variety of shapes, for example, elongated, needle-like, spherical, regular or irregular. The particle size referred to herein is the largest dimension of the particles and can be readily determined from electron photomicrographs using techniques well known to those skilled in the art.

A particularly effective method for forming electrophotographic coating compositions containing the combination of photoconductive titanyl phthalocyanine and titanyl fluorophthalocyanine pigments according to this invention involves a unique milling method which is described in our copending U.S. patent application Ser. No. 485,114, filed Feb. 23, 1990, entitled "Electrophotographic Recording Elements Containing Titanyl Phthalocyanine Pigments and Their Preparation", the disclosure of which is hereby incorporated herein by reference. Briefly, such coating compositions are prepared by a method that comprises the steps of (1) milling an as-synthesized titanyl phthalocyanine-type pigment with milling media comprising inorganic salt and nonconducting particles under shear conditions in the substantial absence of binder and solvent to provide pigment having a particle size up to about 0.2 micrometer, (2) continuing the milling at higher shear and a temperature up to about 50° C. to achieve a perceptible color change in the pigment particles, (3) rapidly increasing the temperature of the milled pigment at least 10° C., (4) separating the milled pigment from the milling media and (5) mixing the milled pigment with a solvent solution of binder to form a coating composition. This method provides a very high degree of dispersion of photoconductive titanyl phthalocyanine-type pigment in solvent solution of binder.

The titanyl phthalocyanine-type pigments used in the practice of this invention are preferably crystalline materials since such materials generally form more stable coating compositions than the corresponding non-crystalline titanyl phthalocyanine-type pigments. The crystallinity of the pigments is typically indicated by substantial peaks at several diffraction angles (2Θ) within the X-ray diffraction pattern obtained with CuKα radiation. In general, the crystalline titanyl phthalocyanine pigments employed in the practice of this invention typically exhibit significant peaks at diffraction angles (2Θ) in the range of about 6 to 30 in the X-ray diffraction pattern obtained with CuKα radiation while the crystalline titanyl fluorophthalocyanine pigments exhibit such peaks in the range of about 6 to 28. Determination of X-ray diffraction characteristics is conveniently carried out in accordance with well known techniques as described for example, in Engineering Solids, by T. S. Hutchinson and D. C. Baird, John Wiley & Sons, Inc., 1963, and X-ray Diffraction Procedures for Polycrystalline and Amorphous Materials, 2d Edition, John Wiley & Sons, Inc., 1974.

The electrophotographic elements of the invention can be of various types, all of which contain the combination of (A) and (B) photoconductive titanyl phthalocyanine-type pigments that serve as charge-generating materials in the elements. The combination comprises at least one (A) titanyl phthalocyanine pigment with at least one (B) titanyl fluorophthalocyanine pigment. The inventive elements include both those commonly referred to as single layer or single-active-layer elements and those commonly referred to as multiactive, multi-layer, or multiactive-layer elements which are briefly referred to previously herein.

Single layer elements contain one layer that is active both to generate and to transport charges in response to exposure to actinic radiation. Such elements typically comprise at least an electrically conductive layer in electrical contact with a photoconductive layer. In single layer elements of the invention, the photoconductive layer contains a combination of (A) and (B) photoconductive pigments as the charge-generation material to generate charge in response to actinic radiation. For optimum photosensitivity such layers typically contain a transport material which is capable of accepting charges generated by the charge-generation material and transporting the charges through the layer to effect discharge of the initially uniform electrostatic potential. The photoconductive layer is electrically insulative, except when exposed to actinic radiation, and contains an electrically insulative binder such as a film-forming polymeric binder which may itself be a charge-generating material or may be an additional material which is not photoconductive.

Multiactive elements contain at least two active layers, at least one of which is capable of generating charge in response to exposure to actinic radiation and is referred to as a charge-generation layer (hereinafter also referred to as a CGL), and at least one of which is capable of accepting and transporting charges generated by the charge-generation layer and is referred to as a charge-transport layer (hereinafter also referred to as a CTL). Such elements typically comprise at least an electrically conductive layer, a CGL, and a CTL. Either the CGL or the CTL is in electrical contact with both the electrically conductive layer and the remaining CGL or CTL. Of course, the CGL contains at least a photoconductive material that serves as a charge-generation material; the CTL contains at least a charge-transport material; and either or both layers can contain an additional film-forming polymeric binder. In multiactive elements of the invention the charge-generation material is a combination of (A) and (B) photoconductive titanyl phthalocyanine-type pigments dispersed in a binder and the element contains a CTL. Any suitable charge-transport material can be used in such CTL's.

Single layer and multilayer electrophotographic elements and their preparation and use, in general, are well known and are described in more detail, for example, in U.S. Pat. Nos. 4,701,396; 4,714,666; 4,725,519; 4,728,592; 4,666,802; 4,578,334; 4,719,163; 4,175,960; 4,514,481; and 3,615,414, the disclosures of which are hereby incorporated herein by reference. The essential difference between electrophotographic elements of the present invention and those generally known elements is that the elements of this invention contain a combination of (A) and (B) photoconductive titanyl phthalocyanine-type pigments that are dispersed in a binder and serve as charge-generation materials. In the combination, the weight of titanyl phthalocyanine (A) pigment is generally in the range of about 1 to 80% and typically 20 to 50%, based upon the weight of the combination.

In preparing single-active-layer electrophotographic elements of the invention, the components of the photoconductive layer, including any desired addenda, can be dissolved or dispersed together in a liquid and can be coated on an electrically conductive layer or support. The liquid is then allowed or caused to evaporate from the mixture to form the permanent layer containing from about 0.01 to 50 weight percent of the charge-generation materials and normally about 10 to 70 weight percent of a suitable charge transport material. Included among many useful liquids for this purpose are, for example, aromatic hydrocarbons such as benzene, toluene, xylene and mesitylene; ketones such as acetone, butanone and 4-methyl-2-pentanone; halogenated hydrocarbons such as methylene chloride, chloroform and ethylene chloride; ethers, including ethyl ether and cyclic ethers such as dioxane and tetrahydrofuran; and mixtures thereof.

In preparing multiactive electrophotographic elements of the invention, the components of the CTL can similarly be dissolved or dispersed in such a liquid coating vehicle and can be coated on either an electrically conductive layer or support or on a CGL previously similarly coated or otherwise formed on the conductive layer or support. In the former case a CGL is thereafter coated on the CTL.

Various electrically conductive layers or supports can be employed in electrophotographic elements of the invention, such as, for example, paper (at a relative humidity above 20 percent); aluminum-paper laminates; metal foils such as aluminum foil and zinc foil; metal plates such as aluminum, copper, zinc, brass and galvanized plates; vapor deposited metal layers such as silver, chromium, vanadium, gold, nickel, and aluminum; and semiconductive layers such as cuprous iodide and indium tin oxide. The metal or semiconductive layers can be coated on paper or conventional photographic film bases such as poly(ethylene terephthalate), cellulose acetate and polystyrene. Such conducting materials as chromium and nickel can be vacuum-deposited on transparent film supports in sufficiently thin layers to allow electrophotographic elements prepared therewith to be exposed from either side.

When coating a photoconductive layer of a single-active-layer element or a CGL of a multiactive element of the invention, a binder such as a film-forming polymeric binder is employed to coat a solution or dispersion of the layer components. The binder may, if it is electrically insulating, help to provide the element with electrically insulating characteristics. It also is useful in coating the layer, in adhering the layer to an adjacent layer, and when it is a top layer, in providing a smooth, easy to clean, wear-resistant surface. A significant feature of this invention is that a CGL containing the (A) and (B) photoconductive titanyl phthalocyanine-type pigments in a binder exhibits a surface that is much more durable than a comparable layer containing the same pigments but formed by vacuum sublimation. This is advantageous in manufacturing operations where such a CGL is subjected to handling prior to overcoating with, for example, a CTL.

The optimum ratio of charge-generation material to binder may vary widely depending on the particular materials employed. In general, useful results are obtained when the amount of active charge-generation material contained within the layer is within the range of from about 0.01 to 90 weight percent, based on the dry weight of the layer.

Representative materials which can be employed as binders in charge-generation layers are film-forming polymers having a fairly high dielectric strength and good electrically insulating properties. Such binders include, for example, styrene-butadiene copolymers; vinyl toluene-styrene copolymers; styrene-alkyd resins; silicone-alkyd resins; soya-alkyd resins; vinylidene chloride-vinyl chloride copolymers; poly(vinylidene chloride); vinylidene chloride-acrylonitrile copolymers; vinyl acetate-vinyl chloride copolymers; poly(vinyl acetals), such as poly(vinyl butyral); nitrated polystyrene; poly(methylstyrene); isobutylene polymers; polyesters, such as poly[ethylene-co-alkylenebis(alkyleneoxyarly)phenylenedicarboxylate]; phenolformaldehyde resins; ketone resins; polyamides; polycarbonates; polythiocarbonates; poly[ethylene-co-isopropylidene-2,2-bis(ethyleneoxyphenylene)terephthalate]; copolymers of vinyl haloacrylates and vinyl acetate such as poly(vinyl-m-bromobenzoate-co-vinyl acetate); chlorinated poly(olefins), such as chlorinated poly(ethylene); cellulose derivatives such as cellulose acetate, cellulose acetate butyrate and ethyl cellulose; and polyimides, such as poly[1,1,3-trimethyl-3-(4'-phenyl)-5-indane pyromellitimide].

Binders should provide little or no interference with the generation of charges in the layer. Examples of binders that are especially useful include bisphenol A polycarbonates and polyesters.

Electrophotographic recording elements of the invention can also optionally contain other addenda such as leveling agents, surfactants, plasticizers, sensitizers, contrast-control agents, and release agents, as is well known in the art.

Also, elements of the invention can contain any of the optional additional layers known to be useful in electrophotographic recording elements in general, such as, e.g., subbing layers, overcoat layers, barrier layers, and screening layers.

The following examples are presented to further illustrate the invention.

EXAMPLE 1

0.1 g of photoconductive titanyl phthalocyanine pigment having a particle size of 0.1 micrometer and 0.15 g of photoconductive titanyl tetrafluorophthalocyanine pigment having a particle size of 0.1 micrometer were added to 14.75 g of a 0.85 percent solids solution of a saturated polyester binder resin (Vylon 200, a product of Toyobo Chemical Co., Japan) in dichloromethane and mixed in a paint shaker for 2 hours. The resulting dispersion was coated on a conductive support comprising a thin conductive layer of nickel on poly(ethylene terephthalate) film to provide a charge-generation layer (CGL) of 0.7 micrometer thickness.

A coating composition (6.5 weight percent solids) for forming a charge-transport layer was prepared by dispersing 203 g of the charge-transport material 1,1-bis(4-di-p-tolylaminophenyl)-3-phenylpropane and 1.27 g of the charge-transport material bis(4-diethylamino)tetraphenylmethane in 7379.3 g of dichloromethane solvent and then adding to the solvent 110..8 g of a bisphenol A polycarbonate binder (sold under the trademark, Makrolon 5705, by Mobay Chemical Co., U.S.A.) and 166.2 g of a second bisphenol A polycarbonate binder (sold under the trademark Lexan 145 by General Electric Co., the U.S.A.) and 30.8 g of poly(ethylene-co-neopentylene terephthalate (60:40 molar ratio) which serves as an adhesion promoter. The mixture was stirred to dissolve the polymers in the solvent and was then coated onto the CGL to form the CTL having a dried thickness of 22 micrometers.

The resulting multiactive eletrophotographic recording element was then charged to a uniform potential of −500 V, exposed at 841.2 nm, its maximum absorption wavelength in the near infrared range, and discharged to −100 V. The energy required in ergs/cm$^2$ was calculated and reported in the following Table 1 as photodecay. The dark decay, i.e., the dark discharge rate for the element, was observed after 15 seconds and is also reported in the following Table 1.

For comparison purposes, this Example was repeated except that 2.5 g of the titanyl phthalocyanine pigment (identified as T-1) or 2.5 g of the titanyl tetrafluorophthalocyanine pigment (identified as T-2) was substituted for the combination of these same pigments. These comparative examples were identified as C-1 and C-2, respectively. The resulting electrophotographic recording elements were exposed at their maximum absorption wavelengths in the near infrared range and their photodecay and dark decay values were determined as described previously in this Example 1. The results are reported in the following Table 1.

TABLE 1

| Example | Pigment | Exposure-Max. Absorption (wavelengths, nm) | Photodecay (erg/cm$^2$) | Dark Decay (V/sec.) |
|---|---|---|---|---|
| 1 | T-1 + T-2 | 841.2 | 1.6 | 1.7 |
| C-1 | T-1 | 832.8 | 3.6 | 4.5 |
| C-2 | T-2 | 826 | 4.2 | 2.3 |

A comparison between the Photodecay values reported in the above table clearly illustrates that the use of the combination of photoconductive pigments according to this invention provides a synergistic and unexpected increase in photosensitivity. Thus, the value reported for photodecay for Example 1 is clearly greater (virtually 2-fold greater) than either of the values reported for C-1 and C-2 for the single pigments and the wavelength of maximum absorption is shifted further out into the infrared range using the combination of pigments. A comparable synergistic improvement in photosensitivity is obtained when the titanyl tetrafluorophthalocyanine pigment employed in this Example is substituted by other titanyl fluorophthalocyanines such as titanyl 1,11,18,25-tetrafluorophthalocyanine, titanyl 2,3,9,10,16,17,23,24-octafluorophthalocyanine or titanyl 1,4,8,11,15,18,22,25-octafluorophthalocyanine. In addition, the electrophotographic recording element using the combination of pigments (Example 1) exhibited a significantly increased sensitivity over the range of 400–900 nm of the electromagnetic spectrum in comparison to the corresponding elements using the individual pigments as in C-1 and C-2.

EXAMPLE 2

A positive-charging electrophotographic recording element was prepared according to this invention using the following coating compositions and procedures, where parts are by weight.

A coating composition for forming the charge-transport layer was prepared by dispersing 769 parts of the charge-transport material 1,1-bis(4-di-p-tolylamino-phenyl)-3-phenylpropane, 760 parts of the charge-transport material tri-p-tolylylamine and 80 parts of the charge-transport material bis(4-diethylamino)tetraphenylmethane in 27127 parts dichloromethane and 11626 parts trichloromethane solvent mixture and then adding to the solvent mixture 100 parts of a bisphenol A polycarbonate binder (sold under the trademark, Makrolon 5705, by Mobay Chemical Co., U.S.A.) and 100 parts of a second bisphenol A polycarbonate binder (sold under the trademark Lexan 145 by General Electric Co., U.S.A.). The components of the composition were stirred to form a solution which was then coated on a conductive support comprising a thin conductive layer of nickel on poly(ethylene terephthalate) film to provide a charge-transport layer (CTL) of 10 micrometers thickness.

A composition was prepared by mixing the following ingredients in a paint shaker for 2 hours: 10 parts of photoconductive titanyl phthalocyanine pigment having a particle size of 0.1 micrometer, 15 parts of photoconductive titanyl tetrafluorophthalocyanine pigment having a particle size of 0.1 micrometer, 8.3 parts of a saturated polyester binder resin (Vylon 200, a product of Toyobo Chemical Co., Japan), 1777 parts of dichloromethane solvent and 333 parts of trichloroethane solvent. Then 31.73 parts of the resulting composition was mixed with 280 parts of the charge-transport layer coating composition prepared according to the procedure set forth in the preceding paragraph of this Example 2 to form a suspension. The resulting suspension was then coated onto the CTL to form a CGL having a dried thickness of 10 micrometers.

The resulting multiactive layer electrophotographic recording element was then charged to a uniform potential of +500 V, exposed at 840 nm and discharged to +100 V.

For comparison purposes, this Example was repeated except that 25 parts of the photoconductive titanyl phtalocyanine pigment (identified as T-3) or 25 parts of the photoconductive titanyl tetrafluorophthalocyanine pigment (identified as T-4) was substituted for the combination of these same pigments. These comparative examples were identified as C-3 and C-4, respectively. The resulting electrophotographic recording elements were exposed at 840 nm. The photodecay and dark decay for all of the electrophotographic elements prepared in this Example 2 were determined as described in Example 1 and the results reported in the following Table 2.

TABLE 2

| Example | Pigment | Photodecay (erg/cm$^2$) | Dark Decay (V/sec.) |
|---|---|---|---|
| 2 | T-3 + T-4 | 3.2 | 3 |
| C-3 | T-3 | 6.5 | 6 |
| C-4 | T-4 | 7.8 | 3 |

EXAMPLE 3

A mixture of 3.6 g of photoconductive titanyl phthalocyanine pigment having a particle size of 0.1 micrometer, 5.4 g of photoconductive titanyl tetrafluorophthalocyanine pigment having a particle size of 0.5 micrometer, 81 g of a saturated polyester binder resin (Vylon 200, a product of Toyobo Chemical Co., Japan) and 810 g of dichloromethane were mixed for 2 hours in a paint shaker containing glass beads having a diameter of 3 mm. The resulting composition was separated from the glass beads and coated on a conductive support comprising a thin conductive layer of nickel on poly(ethylene terephthalate) film to provide a photoconductive coating having a dry thickness of 12.5 micrometers.

The resulting single-active layer electrophotographic recording element was charged to a uniform potential of +500 V, exposed at its maximum absorption wavelength in the near infrared range of 830 nm. The photodecay and dark decay were determined as described in Example 1 and the results reported in the following Table 3.

For comparison purposes, this Example was repeated except that 9 g of the titanyl phthalocyanine pigment (identified as T-5) or 9 g of the photoconductive titanyl tetrafluorophthalocyanine pigment (identified as T-6) was substituted for the combination of these same pigments. These comparative examples were identified as C-5 and C-6, respectively. The resulting electrophotographic recording elements were exposed at 830 nm. The photodecay and dark decay were determined as described in Example 1 and the results reported in following Table 3.

TABLE 3

| Example | Pigment | Photodecay (erg/cm$^2$) | Dark Decay (V/sec.) |
|---|---|---|---|
| 3 | T-5 + T-6 | 3 | 2 |
| C-5 | T-5 | 5 | 3 |
| C-6 | T-6 | 10 | 4 |

EXAMPLE 4

As previously indicated herein, closely structurally related photoconductive titanyl phthalocyanine-type pigments such as the titanyl chloro- and bromo-substituted phthalocyanine pigments cannot be substituted for the titanyl fluorophthalocyanine to provide the synergistic increase in electrophotographic speed achieved with the titanyl fluorophthalocyanine pigments according to the practice of this invention. To illustrate this feature of the invention with a photoconductive titanyl chloro-substituted phthalocyanine pigment, the procedure of Example 1 was first repeated with a charge-generation coating layer composition comprising 2 g of photoconductive titanyl phthalocyanine pigment having a particle size of 0.1 micrometer, 3 g of photoconductive titanyl tetrachlorophthalocyanine pigment having a particle size of 0.1 micrometer, 2.5 g of the saturated polyester binder resin and 242.5 g of dichloromethane solvent to form a CGL having a dry thickness of 0.4 micrometer.

The charge-transport layer coating composition comprised 4 g of the charge-transport material tri-p-tolylylamine, 6 g of the Makrolon 5705 bisphenol A polycarbonate binder and 90 g of dichloromethane solvent and was coated onto the CGL at a dry thickness of 22 micrometers.

For comparison purposes, this Example 4 was repeated except that the combination of titanyl phthalocyanine-type pigments was replaced by a comparable amount of the photoconductive titanyl phthalocyanine pigment (identified as T-7) or titanyl tetrachlorophthalocyanine pigment (identified as T-8). These comparative examples were identified as C-7 and C-8, respectively. The photodecay and dark decay for all of the electrophotographic elements prepared in this Example 4 were determined as described in Example 1 and the results reported in the following Table 4.

TABLE 4

| Example | Pigment | Exposure-Max. Absorption (wavelengths, nm) | Photodecay (erg/cm$^2$) | Dark Decay (V/sec.) |
|---|---|---|---|---|
| 4 | T-7 + T-8 | 830 | 14 | 1.0 |
| C-7 | T-7 | 830 | 3.9 | 3.0 |
| C-8 | T-8 | 830 | 18 | 1.0 |

To illustrate the results obtained with a photoconductive titanyl bromo-substituted phthalocyanine pigment, the procedure of this Example 4 was repeated except that photoconductive titanyl phthalocyanine pigment having a particle size of 0.1 micrometer (identified as T-9) and photoconductive titanyl tetrabromophthalocyanine pigment having a particle size of 0.1 micrometer (identified as T-10) were used as charge-generation materials. The comparative examples using the single photoconductive titanyl phthalocyanine pigment or the titanyl tetrabromophthalocyanine pigment were identified as C-9 and C-10, respectively, while the example using the combination of such pigments was identified as Example 4A. The following Table 5 sets forth the photodecay and dark decay values determined for the various electrophotographic elements.

TABLE 5

| Example | Pigment | Photodecay (erg/cm$^2$) | Dark Decay (V/sec.) |
|---|---|---|---|
| 4A | T-9 + T-10 | 16 | 3.0 |
| C-9 | T-9 | 3.9 | 3.0 |
| C-10 | T-10 | 20 | 2.0 |

A comparison between the photodecay values reported in Tables 4 and 5 for the elements containing the individual photoconductive titanyl phthalocyanine-type pigments and the combination of such pigments demonstrates that there is no synergism achieved with the combination. Clearly, the photodecay values for the combination represent only a compromise value between the photodecay values obtained with the individual pigments. This same lack of synergism resulted when a comparable photoconductive titanyl tetrachlorophthalocyanine or titanyl tetrabromophthalocyanine pigment was substituted for the photoconductive titanyl tetrafluorophthalocyanine pigment in the single-active layer electrophotographic recording elements prepared according to Example 3.

The invention has been described in detail with particular reference to preferred embodiments thereof, but it will be understood that variations and modifications can be effected within the spirit and scope of the invention.

We claim:

1. In an electrophotographic recording element containing photoconductive materials dispersed in a binder, the improvement wherein the photoconductive materials comprise a combination of pigments of (A) titanyl phthalocyanine with (B) titanyl fluorophthalocyanine having the formula:

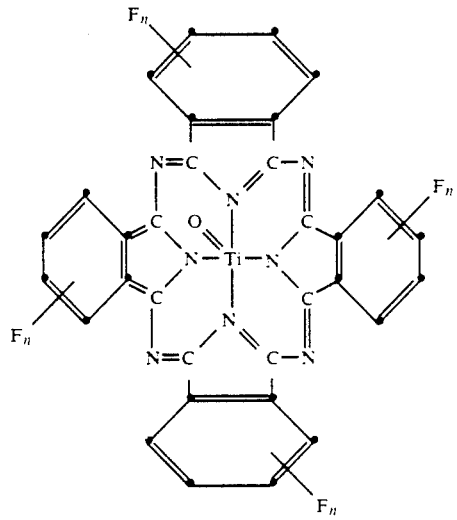

where each n is an integer of 1–4.

2. The electrophotographic recording element of claim 1, wherein each n is 1.

3. The electrophotographic recording element of claim 1, wherein the (A) and (B) pigments have a particle size in the range of about 0.01 to 0.5 micrometer.

4. The electrophotographic recording element of claim 1, wherein the (A) and (B) pigments have a particle size in the range of about 0.05 to 0.1 micrometer.

5. The electrophotographic recording element of claim 1, wherein the element is a single-active-layer element comprising a charge generation layer containing the combination of (A) and (B) pigments.

6. The electrophotographic recording element of claim 1, wherein the element is a multiactive element comprising a charge-generation layer containing the combination of (A) and (B) pigments, and a charge-transport layer.

* * * * *